US007766447B2

(12) United States Patent
Snyder et al.

(10) Patent No.: US 7,766,447 B2
(45) Date of Patent: Aug. 3, 2010

(54) BANDING ADJUSTMENT METHOD FOR MULTIPLE PRINTHEADS

(75) Inventors: Trevor James Snyder, Newberg, OR (US); James D. Padgett, Lake Oswego, OR (US); Terrance L. Stephens, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 205 days.

(21) Appl. No.: 11/796,787

(22) Filed: Apr. 30, 2007

(65) Prior Publication Data

US 2008/0266339 A1 Oct. 30, 2008

(51) Int. Cl.
*B41J 29/393* (2006.01)

(52) U.S. Cl. ..... 347/19; 347/5; 347/14

(58) Field of Classification Search ..... 347/5–9, 347/11, 14, 16, 19, 15, 12
See application file for complete search history.

(56) References Cited

U.S. PATENT DOCUMENTS

| | | | | |
|---|---|---|---|---|
| 5,223,853 | A | 6/1993 | Wysocki et al. | |
| 5,502,468 | A | 3/1996 | Knierim | |
| 5,519,419 | A | 5/1996 | Stephany et al. | |
| 5,712,666 | A * | 1/1998 | Matsubara et al. | 347/19 |
| 6,109,732 | A | 8/2000 | Wen | |
| 6,450,606 | B1 * | 9/2002 | Kato et al. | 347/19 |
| 6,761,426 | B2 * | 7/2004 | Tsuchiya et al. | 347/19 |
| 7,073,878 | B2 | 7/2006 | Nishida et al. | |
| 2003/0025922 | A1 * | 2/2003 | Otsuki | 358/1.2 |
| 2006/0092207 | A1 * | 5/2006 | Shamoun et al. | 347/14 |

FOREIGN PATENT DOCUMENTS

| | | | |
|---|---|---|---|
| EP | 1292117 | A | 3/2003 |

OTHER PUBLICATIONS

EP Search Report, European Patent Office, Munich, Germany, Jun. 29, 2009.

* cited by examiner

*Primary Examiner*—Lam S Nguyen
(74) *Attorney, Agent, or Firm*—Maginot, Moore & Beck LLP

(57) ABSTRACT

A banding adjustment method for an ink jet imaging device having a plurality of printheads comprises printing a plurality of test bands, each test band being printed by a plurality of printheads such that each printhead of the plurality prints a section of each test band. The drop mass generated by each printhead of the plurality is selectively adjusted between a default drop mass and an adjusted drop mass to print each test band of the plurality such that the plurality of printed test bands have various combinations of sections having the default drop mass and the adjusted drop mass. The user is then prompted to select a test band from the plurality of printed test bands.

21 Claims, 4 Drawing Sheets

BANDING ADJUSTMENT METHOD FOR MULTIPLE PRINTHEADS

TECHNICAL FIELD

This disclosure relates generally to imaging devices that eject ink from ink jets onto print drums to form images for transfer to media sheets and, more particularly, to imaging devices that use phase change inks.

BACKGROUND

An ink jet printer produces images on a receiver by ejecting ink droplets onto the receiver in a raster scanning fashion. The advantages of non-impact, low noise, low energy use, and low cost operation are largely responsible for the wide acceptance of ink jet printers in the marketplace.

A typical inkjet printer uses one or more printheads. Each printhead typically contains an array of individual nozzles for ejecting drops of ink onto an ink receiver. It is known to those skilled in the art that undesirable image artifacts can arise due to small differences between the individual nozzles in a printhead. These differences in the nozzles of a print head may be caused by deviations in the physical characteristics (e.g., the nozzle diameter, the channel width or length, etc.) or the electrical characteristics (e.g., thermal or mechanical activation power, etc.) of the nozzles. These variations are often introduced during print head manufacture and assembly. The differences may cause the individual nozzles to produce ink drops that are slightly different in volume from neighboring nozzles. Larger ink drops will result in darker (increased optical density) areas on the printed page, and smaller ink drops will result in lighter (decreased optical density) areas. Due to the raster scanning fashion of the printhead, these dark and light areas will form lines of darker and lighter density often referred to as "banding" or "streaking."

There are many techniques present in the prior art that describe methods of reducing banding artifacts caused by nozzle-to-nozzle differences. For instance, in some prior art systems drop volume variability between nozzles of a printhead has been reduced by "normalizing" each jet or nozzle within a printhead. Normalization of the printhead nozzles is accomplished by modifying the electrical signals, or driving signals, that are used to activate the individual nozzles so that all of the nozzles of the printhead generate an ink drop having substantially the same drop mass.

The inkjet printing market continues to require faster and faster printing of images, and many modifications to the basic inkjet printing engine have been investigated to accommodate this requirement. One method of printing an image faster is to use a printhead that has more nozzles. This prints more image raster lines in each movement of the printhead, thereby increasing the throughput of the printer. However, manufacturing and technical challenges ultimately limit the numbers of nozzles in a printhead. Thus, in some inkjet printers designed for high throughput, multiple printheads are used together that effectively increases the number of nozzles and offer an alternative that is easier to manufacture.

While normalization of the jets in the printhead may be effective in the generation of substantially uniform drop mass across the nozzles of an individual printhead, the "normalized" drop mass produced may vary from printhead to printhead resulting in banding or streaking of a printed image. The normal variations between printheads that may be introduced, for example, during manufacture and assembly may result in printheads that generate ink drops having differing volumes. The average drop mass difference from printhead to printhead may be as high as 2-4 ng.

Techniques have been developed in the prior art to address drop volume variation issues between print heads. For example, U.S. Pat. No. 6,154,227 to Lund teaches a method of adjusting the number of micro-drops printed in response to a drop volume parameter stored in programmable memory on the print head cartridge. Also, U.S. Pat. Nos. 6,450,608 and 6,315,383 to Sarmast et al., teach methods of detecting inkjet nozzle trajectory errors and drop volume using a two-dimensional array of individual detectors. These methods, however, require the use of sophisticated sensors and ink cartridges. The calibration time, cost, and physical space constraints may weigh against the use of these and other possible complex methods. Moreover, tests have shown that even very small printhead to printhead differences in drop mass may be seen. For example, drop mass differences as small as 0.25 ng or less has been found to be visible to the human eye. Measuring drop masses of that size approaches the limits of current measurement tools.

SUMMARY

In one embodiment, a banding adjustment method for an imaging device having a plurality of printheads comprises printing a plurality of test bands, each test band being printed by a plurality of printheads such that each printhead of the plurality prints a section of each test band. The drop mass generated by each printhead of the plurality is selectively adjusted between a default drop mass and an adjusted drop mass to print each test band of the plurality such that the plurality of printed test bands have various combinations of sections having the default drop mass and the adjusted drop mass. The user is then prompted to select a test band from the plurality of printed test bands.

In another embodiment, a banding adjustment system for an imaging device having a plurality of printheads comprises a banding adjustment mode interface for allowing selection of a banding adjustment mode and for receiving prompts. The system includes a test band generator for instructing a plurality of printheads to print a plurality of test bands, each test band being printed by the plurality of printheads such that each printhead of the plurality prints a section of each test band, each section of the test bands being printed by selectively modifying a drop mass generated by each printhead of the plurality between a default drop mass and an adjusted drop mass so that each test band of the plurality has a different combination of sections having the default drop mass and the adjusted drop mass. A controller is in communication with the user interface and the test pattern generator. The controller is operable to instruct the test pattern generator to print the plurality of test patterns in response to selection of the banding adjustment mode and to prompt a user through the user interface to select a test band.

In another embodiment, an imaging device comprises a user interface including a banding adjustment mode selector. The device also comprises a plurality of printheads. Each printhead includes a plurality of ink jet nozzles and a printhead controller for generating a driving signal for each ink jet nozzle. Each driving signal has a voltage level for driving the respective nozzle to emit an ink drop having a drop mass. Each printhead controller is operable to modify the voltage level of the driving signals to adjust the drop mass emitted by the plurality of nozzles. A test band generator drives the plurality of printheads to print a plurality of test bands. Each test band is printed by the plurality of printheads such that each printhead of the plurality prints a section of each test band. Each section of the test bands is printed by selectively modifying the voltage level of the driving signals to adjust a drop mass generated by each printhead of the plurality between a default drop mass and an adjusted drop mass so that each test band of the plurality has a different combination of sections having the default drop mass and the adjusted drop mass. A controller is in communication with the user interface and the test pattern generator. The controller is operable to instruct the test pattern generator to print the plurality of test patterns in response to selection of the banding adjustment mode and to prompt a user through the user interface to select a test band.

BRIEF DESCRIPTION OF THE DRAWINGS

The foregoing aspects and other features of a printer implementing a banding adjustment for multiple printheads are explained in the following description, taken in connection with the accompanying drawings, wherein.

DETAILED DESCRIPTION

Figure 1:
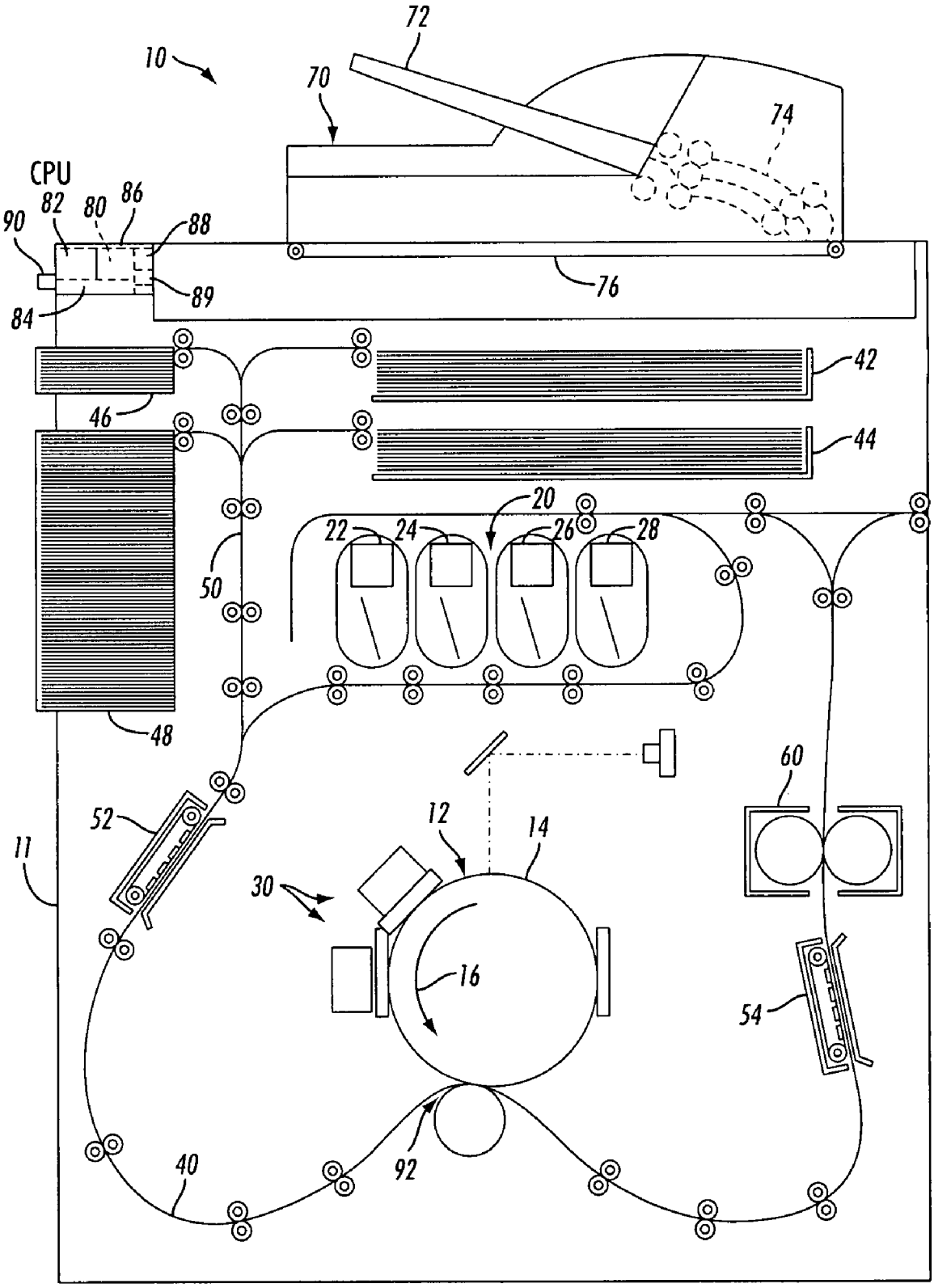
FIG. 1 is a schematic view of a solid ink imaging device.

Referring to FIG. 1, an imaging system 10 is shown. For the purposes of this disclosure, the imaging apparatus is in the form of an inkjet printer that employs one or more inkjet printheads and an associated ink supply. However, the present invention is applicable to any of a variety of other imaging apparatus, including for example, laser printers, facsimile machines, copiers, or any other imaging apparatus capable of applying one or more colorants to a medium or media. The imaging apparatus may include an electrophotographic print engine, or an inkjet print engine. The colorant may be ink, toner, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The imaging device 10 includes a frame 11 to which are mounted directly or indirectly all its operating subsystems and components, as will be described below. To start, the imaging device includes an imaging member 12 that is shown in the form of a drum, but can equally be in the form of a supported endless belt. The imaging member 12 has an imaging surface 14, also referred to herein as an ink receiving surface, which receives molten solid ink ejected from printheads 30 to form images. The receiving surface 14 is movable with respect to the printheads 30 along a receiving surface path as shown by arrow 16.

The printer/copier 10 also includes a solid ink delivery subsystem 20 that has at least one source 22 of one color solid ink in solid form. The printer/copier 10 can be a multicolor image producing machine having an ink delivery system 20 which includes four sources 22, 24, 26, 28, representing four different colors CYMK (cyan, yellow, magenta, black) of solid inks. The solid ink delivery system 20 also includes a melting and control apparatus (not shown in FIG. 1) for melting or phase changing the solid ink from a solid form into a liquid form. The solid ink delivery system 20 is suitable for supplying the ink in liquid form to printhead assembly 30 which eject the ink onto the receiving surface 14, when forming an image. In other applicable examples, the receiving surface 16 can be the substrate. In these examples, the receiving surface path 16 can be the path taken by the substrate during the image forming process which can be referred to as the substrate path, also referred to as the substrate handling path, also referred to as the paper path.

As further shown, the printer/copier 10 includes a substrate supply and handling system 40. The substrate supply and handling system 40 can include a plurality of substrate supply sources 42, 44, 46, 48, of which supply source 48, for example, is a high capacity paper supply or feeder for storing and supplying image receiving substrates in the form of cut sheets. The substrate supply and handling system 40 can include a substrate handling and treatment system 50 that has a substrate pre-heater 52, substrates and image heater 54, and a fusing device 60. The printer/copier 10 can also include an original document feeder 70 that has a document holding tray 72, document sheet feeding and retrieval devices 74, and a document exposure and scanning system 76.

Operation and control of the various subsystems, components and functions of the printer/copier 10 are performed with the aid of a controller 80. The controller 80 can be a self-contained, dedicated computer having a central processor unit (CPU) 82, electronic storage 84, and a display or user interface (UI) 86. The controller 80 can include sensor input and control means 88 as well as a pixel placement and control means 89. The CPU 82 reads, captures, prepares and manages the image data flow between image input sources such as the scanning system 76, or an online or a work station connection 90, and the printheads 30. As such, the controller 80 is the main multi-tasking processor for operating and controlling other machine subsystems and functions, including timing and operation of the printhead assembly as described below.

Figure 2:
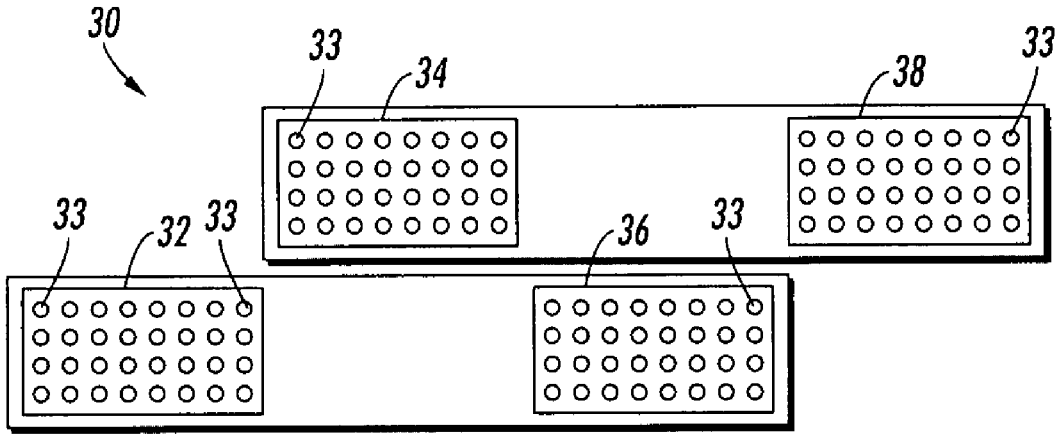
FIG. 2 is a front view of an arrangement of the printheads of the printhead assembly of FIG. 1.
Figure 3:
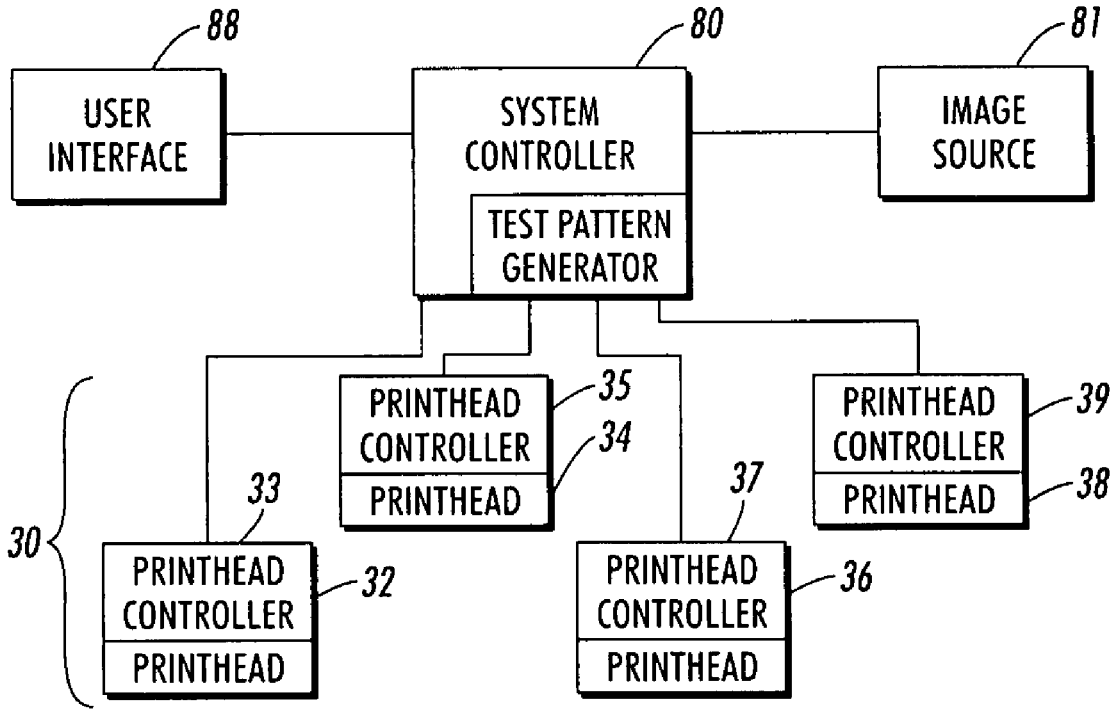
FIG. 3 is a schematic diagram of the printhead assembly and banding adjustment system.

Referring now to FIGS. 2 and 3, the printhead assembly 30 may include a plurality of printheads. FIG. 2 shows an embodiment of a printhead assembly having four printheads 32, 34, 36, 38. Each printhead includes a plurality of openings or apertures 33. In this embodiment, each printhead includes an array of yellow ink jets, an array of cyan ink jets, an array of magenta ink jets, and an array of black ink jets. Thus, each printhead is configured to receive ink from each color source 22, 24, 26, 28 (FIG. 1). In the embodiment of FIG. 2, the printheads 32, 36 are lower printheads while the printheads 34, 38 are upper printheads. While forming an image, a mode referred to herein as print mode, the upper 34, 38 and lower printheads 32, 36 may be staggered with respect to each other in a direction transverse to the receiving surface path in order to cover different portions of the receiving surface. The staggered arrangement enables the printheads 32, 34, 36, 38 to form an image across the full width of the substrate.

FIG. 3 is a schematic diagram of an embodiment of a printhead assembly 30. The operation of each printhead is controlled by one or more printhead controllers 33, 35, 37 39. In the embodiment of FIG. 3, there is provided one printhead controller for each printhead. The printhead controllers 33, 35, 37 39 may be implemented as application specific integrated circuits (ASICs). Each printhead controller may have a power supply (not shown) and memory (not shown). Each printhead controller is operable to generate a plurality of driving signals for driving each ink jet of the printhead to eject an ink drop having substantially the same drop mass. The driving signal may be a periodic signal that is sent to a nozzle and is well known to those skilled in the art. The voltage level, or amplitude, of the driving signal may be varied to adjust the amount of mass in the ink drop ejected by the nozzle. Also, waveform segment lengths or individual segment voltages may be used to separately adjust the dropmass for different fill levels. For example, the first pulse amplitude may be used to drive the mass of full frequency drops, while the length of the final pulse is used to drive the drop mass of half, third or low frequency drops, etc. Adjusting multiple frequencies of the printhead offers better drop mass control over the range of all fill levels (0% up to 100% fill).

As part of a setup or maintenance routine, each printhead controller 33, 35, 37 39 may perform a normalization process as is known in the art to ensure that each ink jet nozzle of the printhead ejects ink drops having substantially the same drop mass. The normalized voltage levels of the driving signals may be saved in memory for the respective printhead controller to access. Once the voltage level of the driving signals has been normalized for each printhead, the normalized driving signals may be recorded by each printhead controller so that the normalized voltages may be used to subsequently drive the ink jet nozzles at a desired level. Thus, to increase or decrease the average drop mass ejected by the plurality of ink jet nozzles of a printhead, the respective printhead controller may uniformly adjust the normalized driving signals by an adjustment voltage. For instance, to increase the average drop mass of a printhead, the printhead controller may increase the voltage level or amplitude of each driving signal by the same amount. The printhead controllers may be programmed with the voltage levels and their corresponding drop masses. The voltage levels and corresponding drop masses may be stored in memory as a data structure such as a table. Alternatively, the printhead controller may include a program or subroutine for calculating the voltage and drop mass relationship. Depending on the actual components and construction of the printhead assembly, there may be a linear relationship between the voltage level of the driving signal and the drop mass. The relationship, however, need not be linear.

During operations, the controller 80 receives print data from an image data source 81. The image data source 81 can be any one of a number of different sources, such as a scanner, a digital copier, a facsimile device that is suitable for generating electronic image data, or a device suitable for storing and/or transmitting electronic image data, such as a client or server of a network, or the Internet. The print data may include various components, such as control data and image data. The control data includes instructions that direct the controller to perform various tasks that are required to print an image, such as paper feed, carriage return, print head positioning, or the like. The image data is the data that instructs the print head to mark the pixels of an image, for example, to eject one drop from an ink jet print head onto an image recording medium. The print data can be compressed and/or encrypted in various formats. The controller 80 generates the printhead image data for each printhead 32, 34, 36, 38 of the printhead assembly 30 from the control and print data received from the image source, and outputs the image printhead data to the appropriate printhead controller 33, 35, 37, 39. The printhead image data may include the image data particular to the respective printhead. In addition, the printhead image data may include printhead control information. The printhead control information may include information such as, for example, instructions to adjust the average drop mass generated by a particular printhead. The printhead controllers 33, 35, 37, 39, upon receiving the respective control and print data from the controller, generate driving signals for driving the piezoelectric elements to expel ink from the ink jet arrays in the printhead to form an image on the imaging member in accordance with the print and control data received from the controller.

As discussed above, due to various factors, the average drop mass may vary from printhead to printhead in the printhead assembly resulting in unsatisfactory image quality. Average drop mass variations smaller than 0.25 ng have been found to be visible to the human eye. While methods have been implemented to normalize drop mass from printhead to printhead, measuring drop masses this small approaches the limits of current measurement tools. Therefore, in order to effectively reduce banding caused by head to head variation in average drop mass, a visually based head to head banding adjustment method is provided.

Figure 4:
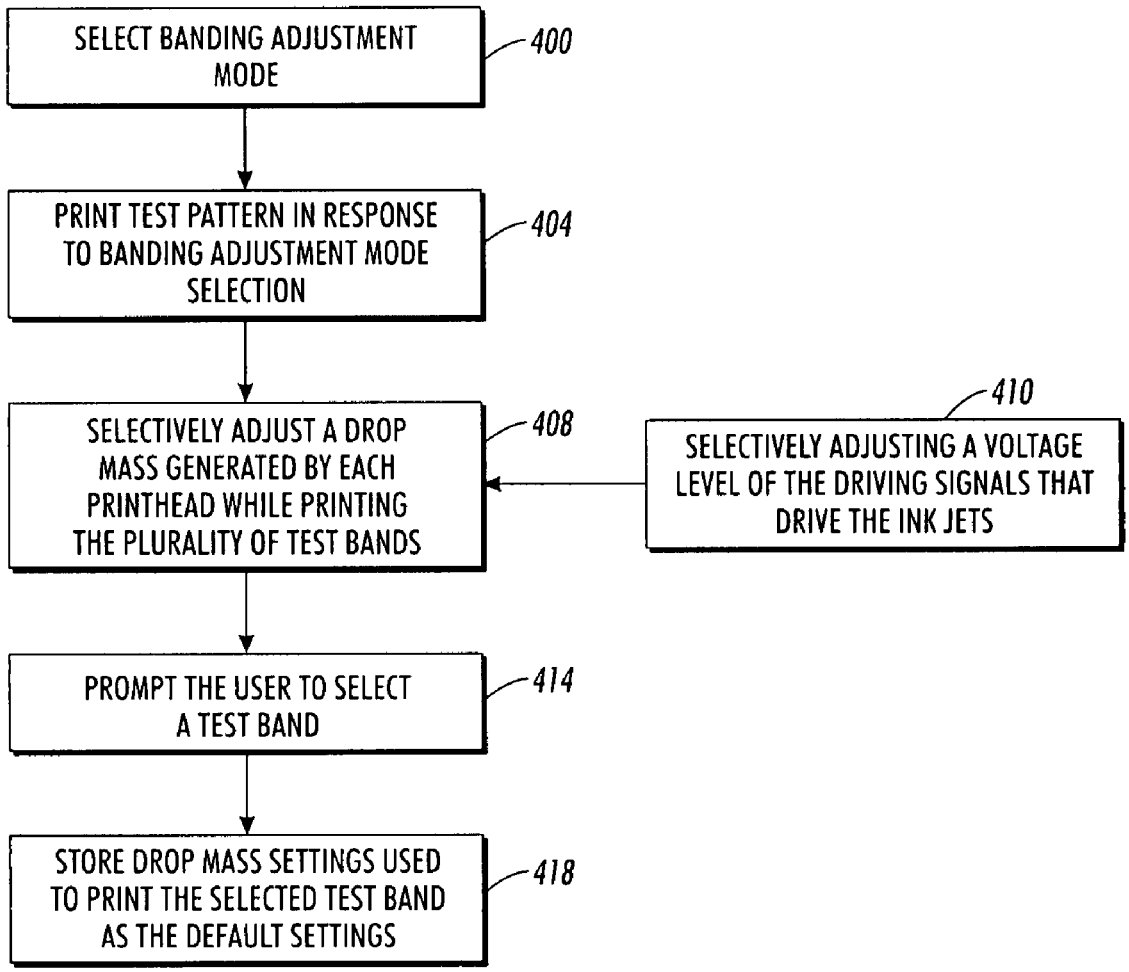
FIG. 4 is a flowchart of a banding adjustment method.

Referring to FIG. 4, there is shown a flowchart of an embodiment of the banding adjustment method for an ink jet imaging device having a plurality of printheads. In the method, a banding adjustment mode is selected by a user (block 400). The user may select the mode in response to an unsatisfactory print job or as part of a setup process. In one embodiment, the banding adjustment mode may be selected by pressing a pushbutton actuator located on the user interface 86. In another embodiment, the banding adjustment mode may be provided as a selectable option, or software button, presented in a user interface of a print engine. By pressing the banding adjustment button or clicking on the banding adjustment option in user interface the banding adjustment mode may be activated.

In response to the selection of the banding adjustment mode, a test pattern is printed by the ink jet imaging device. The test pattern includes a plurality of test bands. A test pattern may be printed for each color used in the imaging device. Alternatively, a single test pattern may be printed that includes test bands pertaining to each color. Each printhead of the plurality of printheads is used to print a portion of each test band. Thus, if a test pattern for cyan is printed, the cyan ink jet nozzles of each printhead are used to print a portion of each test band. The coverage level may be substantially uniform for all printheads and the bands may be at any one or more percent fills from 1% up to 100% fill.

Figure 5:
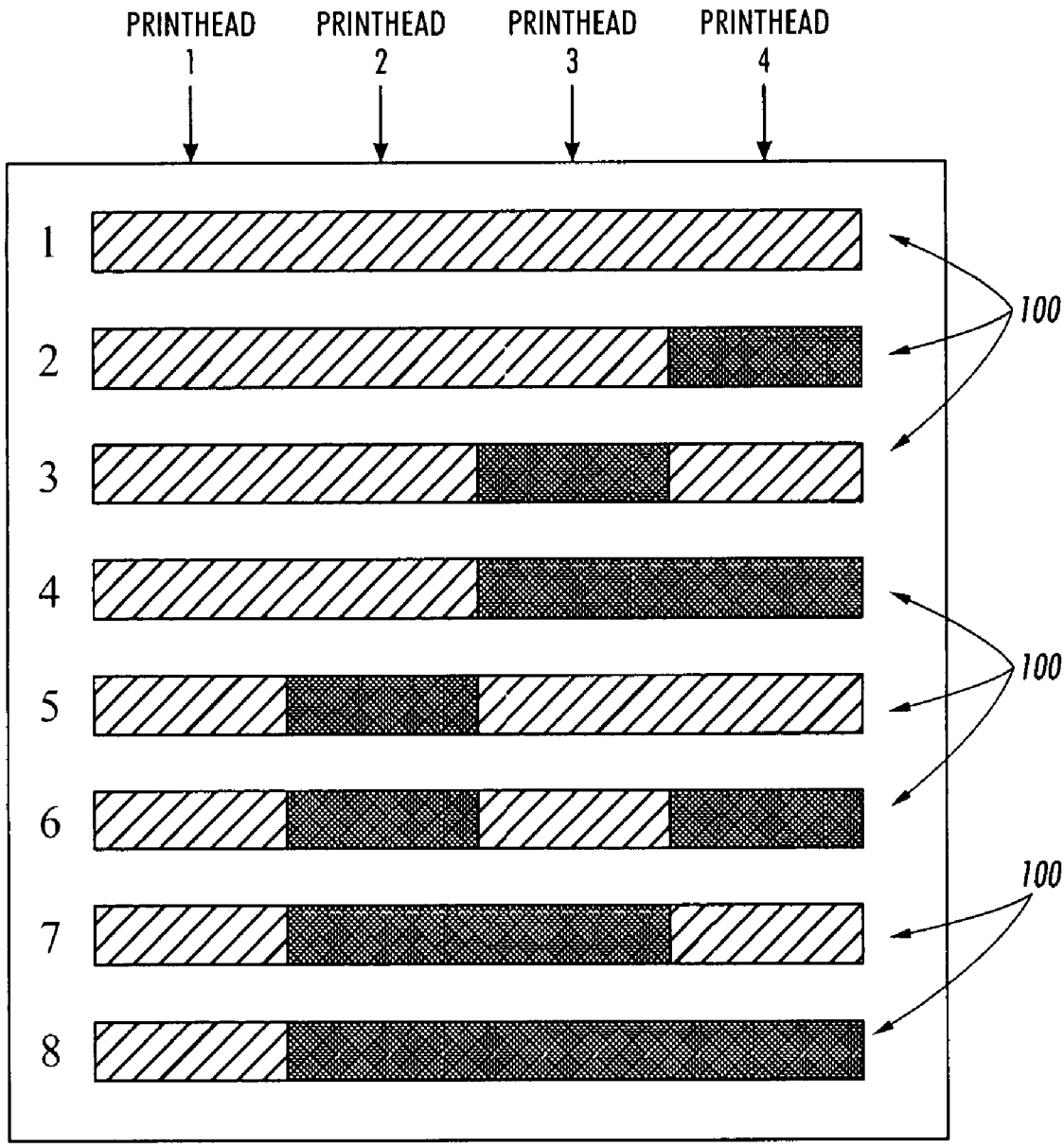
FIG. 5 is an illustration of an embodiment of a test pattern printed by an ink jet imaging device having multiple printheads.

The test bands are printed by selectively adjusting the drop mass output by the printheads while printing the plurality of test bands (block 404). For example, FIG. 5 shows an embodiment of a test pattern having a plurality of test bands 100 for a particular color. Each test band has been printed with each of four printheads, the first portion of each test band being printed by the first printhead, the second portion of each test band being printed by the second printhead, etc. The lightly shaded areas of the test bands 100 indicate no adjustment while the darker shaded areas indicate an adjustment in drop mass by a discrete amount. A first test band may be printed such that no drop mass adjustments are made. A second test and may be printed such that the average drop mass output by the fourth printhead is adjusted by a discrete amount while the drop mass output by the rest of the printheads are output at a default level. A third test band may be printed such that the average drop mass output by a third printhead is adjusted by the discrete amount while the average drop mass output by the remaining printheads remains at the default level, etc. Thus, in one embodiment, the number of test bands that may be printed is a factorial of the number of printheads. If four printheads are used with two levels of driving voltage and one percent fill, sixteen test bands may be printed in a test pattern for each color. The use of more voltage levels or percent fills results in the need for more test bands. For two levels of voltage, the adjustment combinations may be indicated by the following where 0 indicates no drop mass adjustment and 1 indicates drop mass adjustment by a discrete amount: 0000, 0001, 0010, 0011, 0100, 0101, 0110, 0111, 1000, 1001, 1010, 1011, 1100, 1101, 1110, 1111. This banding pattern will be called a "full-factorial" pattern since all possible combinations were represented. However, it is also possible to generate a "partial factorial" of the full set of banding patterns which may be useful under special circumstances. Partial factorial patterns allow for a reduced total number of bands, but with a reduced ability to make a single-step adjustment for all the print heads at once. For example, 1000, 0100, 0010, and 0001 would require the customer to only analyze 4 bands per color instead of 16 and would be done in the conditions when only one head is likely off in drop mass. Another useful pattern set would include the adjustment of only one head, but at multiple different levels. For example, 0000, 0100, 0200, 0300, 0400, etc, where 1,2,3, and 4 indicate different levels of voltage for print head #2. This pattern would be useful in the case of a service related single print head replacement in which it was already known that the three previous heads (#1, #3, and #4) were uniform. Generally speaking, there are typically at least 4 colors to calibrate (CMYK) and anywhere from 2-8 or more printheads. There also may be a need to adjust the drop mass level at more than one percent fill for each color. These numerous factors will result in a large number of bands needed to be printed and viewed by the customer if a full factorial of bands is used. However, other more complex partial factorial methods of data analysis are well known to those skilled in the art and can dramatically reduce the number of bands needed, yet yield sufficient information for correction purposes. Therefore, in another embodiment a partial factorial of levels for color, printhead number, and percent fill is printed and judged by the customer. In this case, the customer may be asked to rank one or more of the bands from best to worst and the ranking is used in the analysis to select the appropriate parameters for each printhead. In another embodiment, a customer may be prompted to rank one or more test bands based using a suitable scale system. For example, the customer may be prompted to rank a test band from 1-5 where 1 is the least satisfactory and 5 is the most satisfactory. One or more of these embodiments may be especially appropriate as an initial screening and may be used to focus subsequent banding calibrations in the areas most needed, i.e., focus on the worst color, or focus on a bad printhead or a certain percent fill, etc.

In one embodiment, the average drop mass output by the ink jet nozzles of a printhead may be adjusted by uniformly increasing or decreasing the voltage level of the driving signals that activate the piezoelectric elements of each ink jet nozzle (block 408). As mentioned above, each printhead controller is configured to generate a plurality of driving signals for causing the plurality of ink jet nozzles of the printhead to eject an ink drop having substantially the same drop mass. To adjust the average drop mass output by the printhead, the voltage level of each driving signal may be increased or decreased by a predetermined adjustment voltage. For example, in one embodiment, the adjustment voltage is 0.5V. Thus, referring again to FIG. 7, test band has been printed such that all the driving signals for the ink jets of printhead have been adjusted by approximately 0.5V while the driving signals for the remaining printheads remain at the default voltage level.

After printing a test pattern for one or more colors in response to selection of the banding adjustment mode, the user is prompted to select a test band of the test pattern that exhibits the least banding, or that looks the best to her or him (block 410). To facilitate the selection or specification of the optimum test band, the plurality of test bands of the test pattern may include an identifier such as, for example, an alphanumeric symbol. For example, the test bands shown in FIG. 5 are numbered 1-8. In this embodiment, the user inputs an identification number allocated to the desirable test band of the test pattern. After the selection of a test band, the drop mass settings of the printheads used to print the selected test band are stored as the default drop mass settings (block 414). For example, in one embodiment, the voltage levels of the driving signals for each printhead that were used to generate the selected test band may be saved as the new default voltage level of the driving signals.

In another embodiment, after a test band is selected by a user, the user may be prompted to continue adjustment or to end adjustment. For example, the banding adjustments provided the first test patterns may look better to the user, but still may not be acceptable. If a user is not satisfied with the banding adjustment, the user may select continue adjustment. The process described above may then be repeated using the new default voltage level of the driving signals. The adjustment voltage, however, may be smaller than the adjustment voltage used in the previous test pattern. For example, if an adjustment voltage of 0.5V is used in a first test pattern, a second test pattern may be generated in which the driving signals for each printhead are selectively adjusted by 0.25V. The banding adjustment may be repeated any number of times while continuously adjusting the driving signal voltages by smaller and smaller amounts until the user is satisfied with the selected test band.

Referring again to FIG. 3, there is shown a schematic diagram of an embodiment of a system for implementing a head to head banding adjustment method. In order to enable a user to select the banding adjustment mode, the system includes a user interface 88 configured to allow the selection of a banding adjustment mode. For example, in one embodiment, the banding adjustment selector may be implemented as a pushbutton actuator located on the user interface 86. In another embodiment, the banding adjustment mode may be provided as a selectable option, or software button, presented in a user interface of a print engine. By pressing the banding adjustment button or clicking on the banding adjustment option in user interface the banding adjustment mode may be activated.

In response to the selection of the banding adjustment mode by a user, the controller 80 commands a test pattern generator 90 to generate test pattern data to be output to each printhead controller 33, 35, 37, 39. In one embodiment, separate test pattern data is generated for each color used in the printhead. The printhead controllers upon receiving the test pattern data for a particular color generate driving signals for driving the piezoelectric elements to expel ink from the ink jet arrays in the printheads to form a test pattern on one or more image substrates (See FIG. 5). The test pattern data includes print data and control data for generating a plurality of test bands on the substrates, each test band being at a substantially uniform coverage level in which the average drop mass for one or more printheads is selectively varied for each test band.

Once the test patterns, or test bands, have been printed the controller 80 prompts the user to select a test band through the user interface. Thus, the user interface includes a display device such as a monitor or a display screen. The user may select a test band, for instance, by inputting an identifier of a test band. The controller in response to a signal indicating a selection of a test band from the user interface 88, may then instruct the printhead controllers to store the drop mass settings used to print the selected test band.

Those skilled in the art will recognize that numerous modifications can be made to the specific implementations described above. For example, those skilled in the art will recognize that while exemplary techniques for evaluating line continuity have been discussed that other techniques may be used as well. Also, while the embodiments above have been described with reference to a solid ink offset printer, the normalization method set out above may be used with any ink jet imaging device, including those that directly print ink receivers. In these devices, for example, the scanner is located at a position past the print head to detect continuity of lines printed on the sheet as it moves through the device. Adjustments may be made for printing on another section of the same sheet or on following sheets and the continuities of these lines detected. The process may continue until the lines are detected as being substantially continuous. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A banding adjustment method for an ink jet imaging device having a plurality of printheads, the method comprising:

controlling each printhead in a plurality of printheads in an inkjet imaging device to print onto a receiving surface at most one section in a test band, the printed sections that comprise each test band extend in a direction transverse to a path of the receiving surface during the printing of the test bands;

selectively adjusting a drop mass for ink drops generated by at least one printhead in the plurality of printheads between a default drop mass and an adjusted drop mass to print at least one section of at least one test band in the plurality of test bands with ink drops having a drop mass different than the default drop mass; and prompting a user to select one of the test bands in the plurality of test bands or to rank at least one of the test bands in the plurality of test bands;

the selective adjustment of the drop mass further comprising:

selectively adjusting a driving signal for each ink jet nozzle of a printhead between a default voltage level and an adjustment voltage level to generate the default drop mass and the adjusted drop mass, respectively;

storing a voltage level of each driving signal used by each printhead that printed a section of the selected test band as a new default voltage level for each printhead in the plurality of printheads that printed a section of the selected test band.

2. The method of claim 1, further comprising:

selecting a banding adjustment mode for the ink jet imaging device; and the control of the plurality of printheads further comprising:

controlling the plurality of printheads to print at most one section in the test bands in accordance with the selected banding adjustment mode.

3. The method of claim 1, the control of the plurality of printheads to print the test bands further comprising:

controlling at least one printhead to print an identifier for each test band in the plurality of test bands.

4. The method of claim 3, the prompting of the user to select a test band further comprising:

prompting the user to input the identifier printed with the selected test band.

5. The method of claim 1, further comprising:

determining a drop mass generated by each printhead used to print a section of the selected test band; and storing the determined drop mass as a default drop mass for the printhead used to print the section of the selected test band.

6. The method of claim 5, further comprising:

in response to the selection of a test band by the user, printing a second plurality of test bands onto a receiving surface with the plurality of printheads, each printhead in the plurality of printheads being controlled to print at most one section of each test band in the second plurality of test bands, the printed sections comprising each test band extending in a direction tranverse to a path of the receiving surface during the printing of the test bands;

selectively adjusting a drop mass for ink drops generated by at least one printhead in the plurality of printheads between the default drop mass stored for the printhead and a second adjusted drop mass to print at least one section of at least one test band in the second plurality of test bands with ink drops having a drop mass different than the default drop mass stored for the at least one printhead that was selectively adjusted; and prompting a user to select a second test band.

7. The method of claim 1, the control of the plurality of printheads further comprising:

controlling the plurality of printheads to print a pattern of test bands for at least one color with a full factorial pattern.

8. The method of claim 1, the control of the plurality of printheads further comprising:

controlling the plurality of printheads to print a pattern of test bands for at least one color with a partial factorial pattern.

9. The method of claim 1, the selective adjustment of the drop mass further comprising:

selectively adjusting a drop mass for ink drops generated by a single printhead in the plurality of printheads to one of the drop mass values for ink drops generated by one of the other printheads in the plurality of printheads.

10. A banding adjustment system for an ink jet imaging device having a plurality of printheads, the system comprising:

a banding adjustment mode interface for allowing selection of a banding adjustment mode and for receiving prompts;

a test pattern generator configured to generate test pattern data for a plurality of printheads that print a plurality of test bands onto a receiving surface, each printhead in the plurality of printheads prints at most one section of each test band, the sections comprising each test band extending in a direction transverse to a path of the receiving surface during the printing of the test bands, each section of each test band being printed by selectively modifying a drop mass for ink drops generated by the printhead in the plurality of printheads that printed the section between a default drop mass and an adjusted drop mass to enable each test band in the plurality of test bands to have at least one section formed with ink drops having the default drop mass and at least one section formed with ink drops having the adjusted drop mass; and a controller in communication with the banding adjustment mode interface and the test pattern generator, the controller operable to generate signals for the test pattern generator to generate the plurality of test patterns in response to selection of the banding adjustment mode and to prompt a user through the banding adjustment mode interface to select one of the printed test bands;

the controller further selectively adjusts the drop mass by:

selectively adjusting a driving signal for each ink jet nozzle of a printhead between a default voltage level and an adjustment voltage level to generate the default drop mass and the adjusted drop mass, respectively;

storing a voltage level of each driving signal used by each printhead that printed a section of the selected test band as a new default voltage level for each printhead in the plurality of printheads that printed a section of the selected test band.

11. The system of claim 10, the test pattern generator being configured to drive the plurality of printheads to print a plurality of test bands for a single color of ink.

12. The system of claim 10, the test pattern generator being configured to drive the plurality of printheads to print a plurality of test bands for each of a plurality of colors of ink.

13. The system of claim 10, each printhead in the plurality of printheads being configured to print each test band in the plurality of test bands with an identifier in response to the test pattern generated by the test pattern generator for the printhead.

14. The system of claim 13, the controller being configured to receive a signal from the banding adjustment mode interface indicating an identifier of a test band, and, in response to the test band identifier signal, to generate control signals for each printhead controller to store a drop mass used to print the selected test band as the default drop mass.

15. The system of claim 10, the test pattern generator being configured to generate test patterns for the plurality of printheads to print a pattern of test bands for at least one color with a full factorial pattern.

16. The system of claim 10, the test pattern generator being configured to generate test patterns for the plurality of printheads to print a pattern of test bands for at least one color with a partial factorial pattern.

17. The system of claim 10, the test pattern generator being configured to generate test patterns for the plurality of printheads to print a plurality of test bands by selectively adjusting a drop mass for ink drops generated by a single printhead in the plurality of printheads to one of the drop mass values for ink drops generated by the other printheads used to print the selected test band.

18. An ink jet imaging device comprising:

a user interface including a banding adjustment mode selector;

a plurality of printheads, each printhead including a plurality of ink jet nozzles and a printhead controller for generating a driving signal for each ink jet nozzle, each driving signal having a voltage level for driving an ink jet nozzle to emit an ink drop having a drop mass, each printhead controller being operable to modify the voltage level of the driving signals to adjust the drop mass emitted by the plurality of nozzles;

a test pattern generator coupled to the plurality of printheads, the test pattern generator being configured to generate a plurality of test patterns that operate the plurality of printheads to print a plurality of test bands onto a receiving surface, each printhead in the plurality of printheads prints at most one section of each test band, the sections comprising each test band extending in a direction transverse to a path of the receiving surface during the printing of the test bands, each section of the test bands being printed by selectively modifying a voltage level of the driving signals to one of the printheads to adjust a drop mass generated by the printhead between a default drop mass and an adjusted drop mass to enable each test band in the plurality of test bands to have at least one section formed with ink drops having the default drop mass and at least one section formed with ink drops having the adjusted drop mass; and a controller in communication with the user interface and the test pattern generator, the controller operable to generate signals that operate the test pattern generator to generate the plurality of test patterns in response to selection of the banding adjustment mode and to prompt a user through the user interface to select one of the printed test bands;

the controller further selectively adjusts the drop mass by:

selectively adjusting a driving signal for each ink jet nozzle of a printhead between a default voltage level and an adjustment voltage level to generate the default drop mass and the adjusted drop mass, respectively;

storing a voltage level of each driving signal used by each printhead that printed a section of the selected test band as a new default voltage level for each printhead in the plurality of printheads that printed a section of the selected test band.

19. The system of claim 18, the banding adjustment mode selector being provided as a pushbutton option on a control panel of an ink jet imaging device.

20. The system of claim 18, the banding adjustment mode selector comprising a user selectable option in a print engine of an ink jet imaging device.

21. The system of claim 18, the controller being configured to receive a signal from the user interface indicating an identifier of a test band, and, in response to the test band identifier signal, the controller is configured to generate control signals to each printhead controller to store one of the voltage levels for the plurality of driving signals used by the printheads to generate the sections of the selected test band.

* * * * *